United States Patent [19]

Young

[11] Patent Number: 4,489,517

[45] Date of Patent: Dec. 25, 1984

[54] REVERSIBLE DOOR AND FRAME ASSEMBLY

[75] Inventor: William S. Young, Plymouth, Ind.

[73] Assignee: Twin Y Corporation, Ligonier, Ind.

[21] Appl. No.: 431,267

[22] Filed: Sep. 30, 1982

[51] Int. Cl.[3] ..... E05D 7/02

[52] U.S. Cl. ..... 49/382; 49/504

[58] Field of Search ..... 49/382, 504

[56] References Cited

U.S. PATENT DOCUMENTS

| | | | |
|---|---|---|---|
| 1,822,251 | 9/1931 | Thies | 49/382 |
| 1,860,438 | 5/1932 | Thies | 49/382 |
| 2,541,871 | 2/1951 | Heijmer et al. | 49/382 X |
| 2,652,907 | 9/1953 | Miller | 49/504 |

FOREIGN PATENT DOCUMENTS

| | | | |
|---|---|---|---|
| 588641 | 5/1947 | United Kingdom | 49/504 |

*Primary Examiner*—Kenneth Downey

*Attorney, Agent, or Firm*—Welsh & Katz, Ltd.

[57] ABSTRACT

A reversible door and frame assembly wherein the frame includes generally channel shaped hinge and lock frame members adapted for assembled cooperation with an upper head frame member and a lower sill member. The hinge side frame member carries a hinge plate at its midpoint and symmetrically positioned upper and lower hinge plates. The lock frame member has a dead bolt opening located at its midpoint and has a pair of openings spaced symmetrically from the dead bolt hole and behind which are mounting plates adapted to releasibly support interchangeable striker and cover plates. The hinge and lock frame members have substantially identical opposite tab ends which provide interconnection with the upper header frame member and enable end for end reversal for right-hand or left-hand hanging of the door which, for this purpose, has substantially identical opposite side surfaces and longitudinal outwardly extending hinge mounting edges facilitating reverse mounting of hinge plates for left-hand or right-hand hanging with the hinge frame member.

17 Claims, 6 Drawing Figures

18
56
24a
26a
10
5.
5.
12
40
40a
42
46
16
14
58
20

18
106
94
90
18a
94
88
86
116
18c
18b
66
110
106
116
16
70a
82
74a
78
78a
82
72a
16a
16c
16b
110
106
116
96
94
100
94
96
86
102
20a
20
106
116
90
94
86
88
94
116
34b
36
32b
106
36a
32a
14c
34a
14b
46a
54
14a
4
62
46
46b
106
116

REVERSIBLE DOOR AND FRAME ASSEMBLY

The present invention relates generally to reversible door and frame assemblies, and more particularly to a novel reversible replacement door and frame assembly which enables the door to be hung for either right-hand or left-hand opening and which lends itself to on-site assembly.

Doors and associated door frames of the type which can be mounted within an existing door opening and which enable the door to be reversed for either right-hand or left-hand opening are generally known. See, for example, U.S. Pat. Nos. 1,822,251 to U. C. Thies and 2,652,907 to K. B. Miller. The Thies door is constructed of sheets of metal and is characterized as having a pair of door stiles one of which carries at its mid-length a reversible latch and lock casing and the other of which is provided with hinges insertable through the door in a reversible manner such that reversal of the hinges and the latch and lock casing enables the door to be converted from a right-hand to a left-hand swing door. The door jamb which cooperates with the door latch and lock is provided with a latch hole located centrally along its length for cooperation with the centrally located latch of the door.

The aforementioned Miller patent discloses a reversible hollow metal door frame characterized in that a hinge jamb carries a pair of hinge leaves equidistant from the top and bottom of the hinge jamb, and a strike jamb is provided with an opening in which a strike plate is mounted such that the horizontal center line of the strike plate is central of the length of the strike jamb and has a pair of slots arranged equidistant from the center line and configured to enable the strike plate to selectively occupy four different positions and thereby provide a bolt-receiving hole selectively in four different positions.

While the door frame structures disclosed in the referenced Thies and Miller patents enable end for end reversal of the hinge and latch or strike jambs to enable either right-hand or left-hand hanging of a door, the jambs do not readily lend themselves to use in a door and frame assembly which is intended as a reversible replacement door and which enables mounting of the frame assembly within an existing door opening without substantial modification. Moreover, the door and frame arrangements disclosed in the Thies and Miller patents are relatively complex in construction, thereby resulting in higher manufacturing and installation costs.

SUMMARY OF THE INVENTION

One of the primary objects of the present invention is to provide a novel reversible door and frame assembly which provides substantial improvements over the prior known reversible door and frame assemblies.

A more particular object of the present invention is to provide a novel door and frame assembly which is readily adapted for on-site assembly within an existing door opening, thereby facilitating ease of installation and improved operation as a replacement door.

Still another object of the present invention is to provide a novel reversible door and frame assembly having reversible hinge frame and latch or lock frame members which are cooperative with an upper header frame member and a lower sill member to establish a relatively rigid frame which may be readily mounted within an existing door opening in a manner to facilitate either right-hand or left-hand hanging of an associated door.

A feature of the present invention lies in the provision of a hinge frame member having hinge plates fixed thereto in symmetrical relation to the mid-length of the hinge frame member, and a latch or lock frame member having a central bolt hole and a pair of openings spaced symmetrically from the bolt hole and including means enabling interchangeable mounting of a striker plate and cover plate within the formed openings in a manner enabling end for end reversal of the frame members for right-hand or left-hand mounting of an associated door.

Another feature of the invention lies in the provision of a reversible door assembly which finds particular application as a replacement door in an existing door opening and which includes generally channel shaped reversible hinge and lock frame members and a door having longitudinal outwardly extending wooden hinge mounting flanges having hinge plate recesses formed to facilitate reversible mounting of hinge plates or leaves without need for further working of the door.

Further objects, advantages and features of the present invention, together with its organization and manner of operation, will become apparent from the following detailed description of the invention when taken in conjunction with the accompanying drawings wherein like reference numerals designate like elements throughout the several views.

DESCRIPTION OF PREFERRED EMBODIMENT

Figures 1, 2:
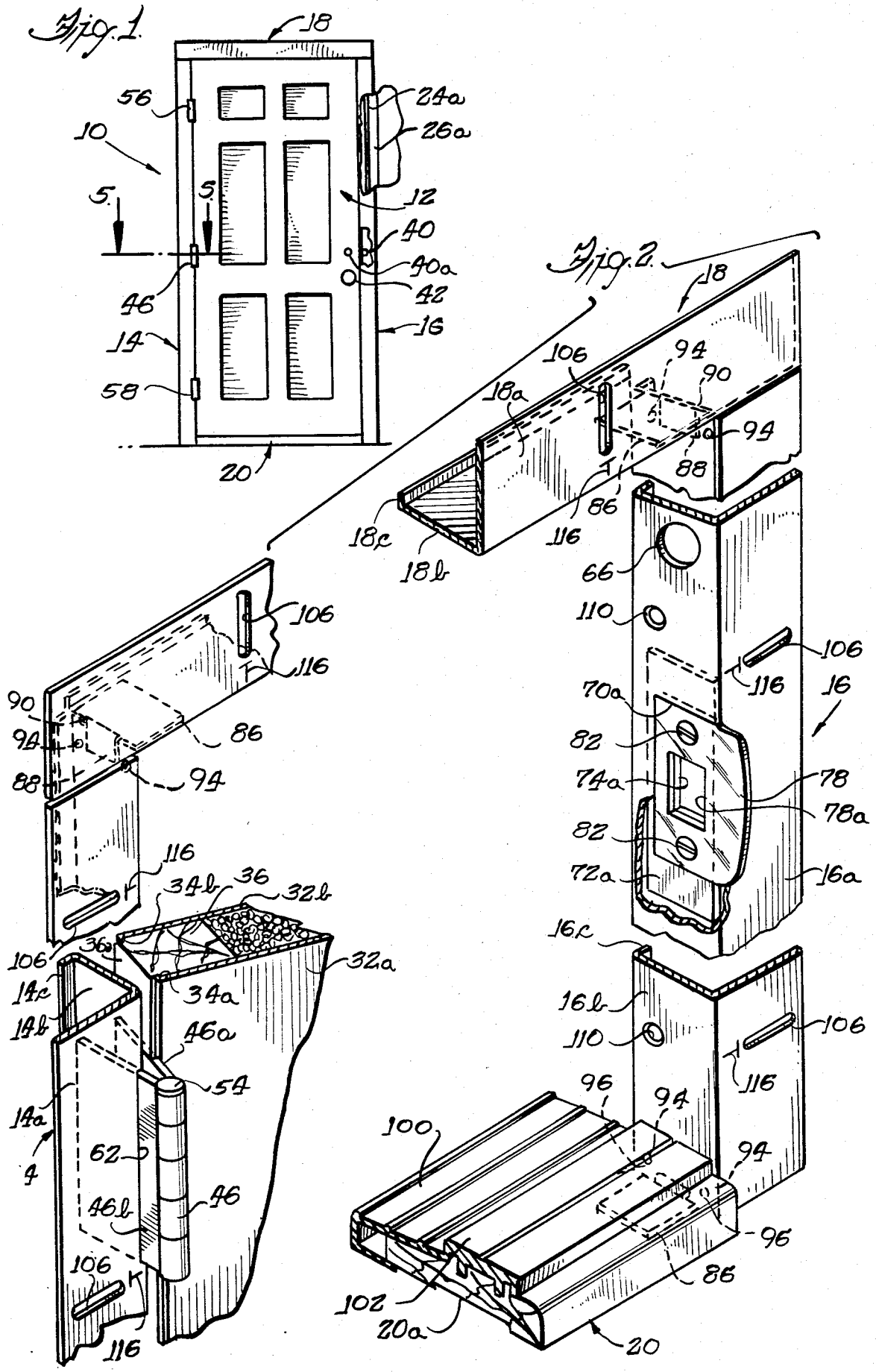
FIG. 1 is a front elevational view of a door and frame assembly in accordance with the present invention mounted within a door opening.
FIG. 2 is a fragmentary and foreshortened perspective view, on an enlarged scale, of the door frame assembly shown in FIG. 1, portions being broken away for purposes of clarity.

Referring now to the drawings, a reversible door and frame assembly constructed in accordance with the present invention is indicated generally at 10 in FIG. 1. Very generally, the reversible door and frame assembly 10 includes a door 12 which is hingedly mounted on a frame assembly comprising a hinge frame member 14, a lock and bolt frame member 16, a head frame member 18 and a lower sill member 20. As will be hereinafter described, the hinge frame member 14 and lock and bolt frame member 16 have substantially identical opposite end configurations and are symmetrical about their longitudinal midpoints so as to enable end for end reversal, the door 12 also being reversible to enable mounting of the door for either right-hand or left-hand opening.

The reversible door and frame assembly 10 is particularly adapted for use as a replacement door to be mounted in an existing door opening in a building or the like. In the illustrated embodiment, such an existing door opening is defined by a pair of laterally spaced generally vertical jamb members, indicated at 24a and 24b in FIGS. 1 and 3, each of which is in turn fixedly mounted to a suitable vertical structural member 26a and 26b, respectively. The structural members 26a,b are typically wood and, with an associated upper horizontal structural member (not shown), establish the "rough opening" within which the vertical jambs 24a,b and an upper horizontal jamb member (not shown) are affixed. The illustrated door opening is formed in an interior wall such that wallboard 28 or other suitable wall construction completes the wall area peripherally of the door opening in a conventional manner.

Figure 5:
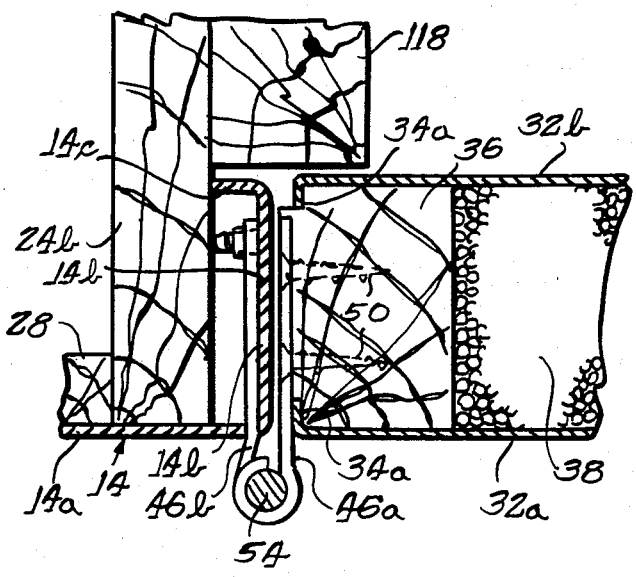
FIG. 5 is a fragmentary enlarged transverse sectional view taken substantially along line 5—5 of FIG. 1.
Figure 6:
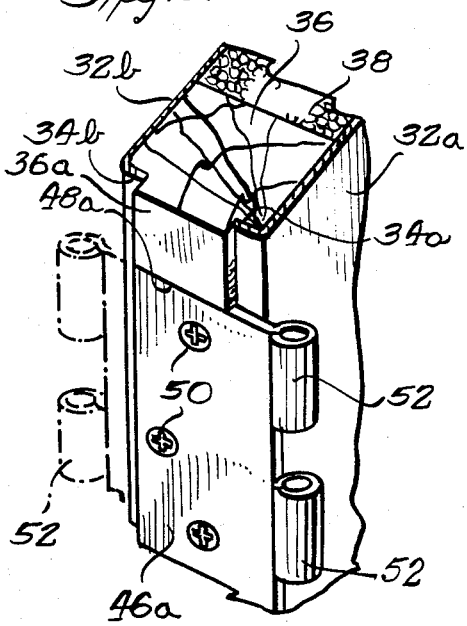
FIG. 6 is a fragmentary perspective view illustrating the manner of mounting hinge plates or leaves on the door.

Turning now to a more detailed description of the reversible door and frame assembly 10, the door 12 includes substantially identical opposite surfaces 32a and 32b which, in the illustrated embodiment, are defined by metallic sheets which may be planar or otherwise embossed or formed into a desired pattern. The metallic sheet surfaces 32a,b have in-turned marginal edge portions 34a,b, respectively, which extend about the full periphery of the sheet surfaces. The in-turned edge portions 34a,b are affixed to a rectangular wooden framework which includes laterally opposite longitudinally extending wooden frame members, one of which is indicated at 36 in FIGS. 2,5 and 6, and upper and lower transverse wooden frame members (not shown) connected at their opposite ends to the upper and lower ends of the longitudinal frame members. The wooden frame members of the door extend outwardly between the in-turned flanges 34a,b of the sheet surfaces 32a,b so as to define outwardly extending flanges 36a of substantially rectangular transverse configuration, as best illustrated in FIGS. 5 and 6. A foam core material 38 is provided within the cavity defined between the inner and outer metallic surfaces 32a,b and the peripheral wooden framework 36 so as to form a lightweight core for the door.

The door 12 preferably has a dead bolt lock mechanism mounted within one edge portion of the door such that the longitudinal axis of a dead bolt, a portion of which is indicated at 40 in FIG. 1, lies on the horizontal or transverse center line of the door. The dead bolt 40 is actuated by a key actuated mechanism 40a in a conventional manner. A conventional door latch assembly, the handle portion of which is shown at 42 in FIG. 1, is mounted within the same edge portion of the door as the dead bolt lock mechanism such that the door latch is slightly below the dead bolt. Manual rotation of the handle 42 effects retraction of an outwardly biased latch bolt (not shown) in a conventional manner.

The longitudinal edge of the door 12 opposite the edge in which the dead bolt 40 and latch 42 are mounted has a hinge plate 46a mounted thereon at its longitudinal center or midpoint, the hinge plate 46a being mounted within a transverse recess 48a formed in the corresponding outwardly extending flange portion 36a of the door as illustrated in FIG. 6. The hinge plate 46a is releasibly secured within the transverse recess 48a by symmetrically positioned screws 50 such that the hinge plate may be reversed from a position wherein a hinge axis 52 is parallel to and forward of the plane of the outer door surface 32a, as shown in solid lines in FIG. 6, to a position wherein the hinge axis is parallel to and outwardly from the plane of the door surface 32b, as shown in phantom in FIG. 6. In this manner, on-site installation of the hinge plates may be made depending upon the selected right-hand or left-hand hanging of the door.

It will be appreciated that the illustrated hinge plate 46a is but one hinge plate or leaf of a hinge assembly 46 the opposite hinge plate of which is indicated at 46b in FIG. 5 and which may be pivotally mounted on the hinge plate 46a through a releasible hinge pin 54 in a conventional manner. The door 12 has hinge assemblies 56 and 58 mounted thereon along the same edge as the hinge assembly 46 and in symmetrical relation to the center hinge 46, the hinge assemblies 56 and 58 also enabling reversible mounting on the edge of the door in similar fashion to hinge assembly 46.

The hinge frame member 14, lock frame member 16 and upper head frame member 18 may be formed from a suitable gauge metallic sheet material and each has a similar generally C-shaped channel transverse cross sectional configuration as illustrated in FIG. 2. The hinge frame member 14 includes a relatively broad faced mounting flange 14a formed integral with a web 14b which in turn has its edge opposite the flange 14a formed to define a relatively narrow flange 14c parallel to flange 14a. In similar fashion, the lock frame member 16 includes a relatively broad faced flange 16a formed integral with a web 16b which in turn has its opposite lateral edge formed to define a relatively narrow flange 16c parallel to and extending in the same direction as flange 16a relative to web 16b. Similarly, the head frame member 18 includes a relatively broad faced flange 18a formed integral with a web 18b having its opposite lateral edge formed to define a relatively narrow flange 18c parallel to and spaced from the flange 18a so as to establish a generally C-shaped channel The hinge frame member 14 has three rectangular slots formed through flange 14a of a suitable size to receive associated hinge plates or leaves of the hinge assemblies 46, 56 and 58, one such rectangular slot being shown at 62 in FIG. 2 receiving the hinge plate 46b therethrough. The hinge plates of the hinge assemblies 46, 56 and 58 which are inserted through the slots in the flange 14a are fixedly secured to the inner surface of the flange 14b as by welding so as to provide preassembly of the hinge plates onto the hinge frame member 14. With the hinge assemblies 46, 56 and 58 being symmetrical relative to the longitudinal midpoint or center of the hinge frame member 14, it will be appreciated that the hinge frame member may be reversed end for end for mounting on either the right-hand or left-hand edge of the door opening in which the door and frame assembly 10 is to be installed.

In accordance with the present invention, the lock and bolt frame member 16 similarly enables end for end reversal while accommodating use with the door 12. To facilitate such end for end reversal, the lock and bolt frame member 16 has a generally circular opening 66 formed in the web 16b at the longitudinal midpoint or center thereof and of sufficient size to receive the dead bolt 40 irrespective of whether the lock frame member 16 is mounted for left-hand or right-hand hinge mounting of the door 12. Should the lock frame member 16 be employed with a door which does not include a dead bolt, a suitable plug 68 may be inserted within the opening 66 so as to lie substantially flush with the outer surface of the web 16b.

Figure 3:
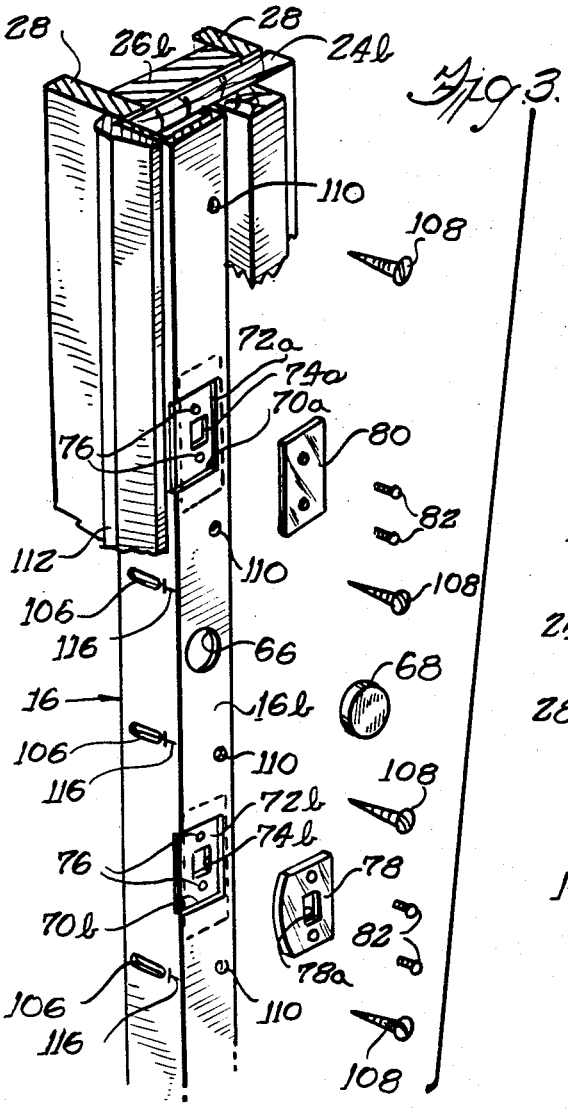
FIG. 3 is a fragmentary perspective and partially exploded view of the lock frame member of FIG. 2 but shown in a reversed position and in a typical installation.

Since the latch assembly 42 is mounted on the door 12 beneath the centrally positioned dead bolt 40, the lock frame member 16 is provided with a pair of substantially identically shaped rectangular openings 70*a* and 70*b* formed in the web 16*b* on opposite sides of the bolt opening 66, as illustrated in FIG. 3. The rectangular openings 70*a,b* are symmetrical relative to the central bolt opening 66 and each is positioned a distance from the dead bolt opening sufficient to lie in horizontally opposed relation to the latch assembly 42, depending upon right-hand or left-hand mounting of the lock frame member 16. A pair of rectangular mounting plates 72*a* and 72*b* are affixed, as by welding, to the inner surface of the web 16*b* so as to lie behind the openings 70*a* and 70*b*, respectively. Each of the mounting plates 72*a,b* has a generally rectangular opening formed centerally therein, such as indicated at 74*a* and 74*b*, resepctively, and also has a pair of tapped bores 76 the centers of which lie substantially on the longitudinal center of the web 16*b* as do the centers of the rectangular openings 74*a,b*. The mounting plates 72*a,b* enable selective interchangeable mounting of a striker plate 78 and cover plate 80 within the openings 70*a* and 70*b* as through screws 82, the striker plate 78 having a rectangular opening 78*a* adapted to overlie the rectangular opening 74*a* or 74*b* within the mounting plate on which the striker plate is mounted.

Figure 4:
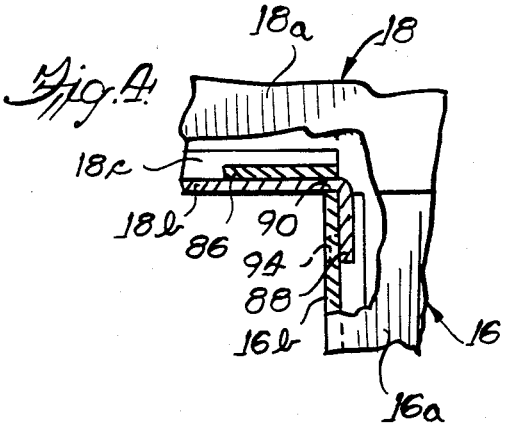
FIG. 4 is a fragmentary elevational view, on an enlarged scale, illustrating the manner of interconnecting the upper ends of the hinge and lock frame members to the upper head frame member, portions being broken away for purposes of clarity.

As aforementioned, the opposite ends of the hinge frame member 14 and lock frame member 16 are substantially identical and are configured such that the upper ends of the hinge and lock frame members are releasibly cooperable with the head frame member 18 to facilitate assembly into a rectangular door frame prior to insertion within the opening defined by the jambs 26*a,b*. With particular reference to FIG. 4 taken in conjunction with FIG. 2, a representative end of the hinge and lock frame members is shown in FIG. 4 as being formed on the upper end of the lock frame member 16. A generally rectangular tab 86 is formed integral with the web 16*b* so as to extend outwardly therefrom in normal relation thereto. A somewhat similar tab 88 is formed on each of the opposite ends of the head frame member 18, the tabs 88 being slightly smaller than the tabs 86 and being adapted for insertion through the upper ones of transverse rectangular openings 90 formed in the opposite ends of the webs 14*b* and 16*b* adjacent the tabs 86. During assembly, the head frame member 18 and the upper ends of the hinge and lock frame members are manipulated to enable insertion of the tabs 88 through the corresponding rectangular openings 90 whereafter the hinge and lock frame members are positioned in substantially normal relation to the head frame member. In this manner, the hinge and lock frame members are maintained in assembled laterally spaced relation with the head frame member 18 as illustrated in FIG. 2.

To maintain the lower ends of the hinge and lock frame members in relatively fixed laterally spaced relation, the opposite ends of the hinge and lock frame members are each provided with a pair of openings 94 which facilitate securing of the lower ends of the hinge and lock frame members to the transverse lower sill member 20. In the illustrated embodiment, the sill member 20 is made of wood and has a longituidinal recess 20*a* formed in its lower surface of sufficient size to receive the tabs 86 on the lower ends of the hinge and lock frame members so that the web portions of these frame members abut the opposite ends of the sill member. With the vertical frame members so positioned, securring means in the form of screws 96 (FIG. 2) may be inserted through the openings 94 and threaded into the corresponding ends of the sill member 20. The sill member 20 may have a metallic tread 100 and a nonmetallic saddle 102 mounted thereon if desired.

When installing the door and frame assembly 10 into an existing door opening, the hinge and lock frame members are positioned for right-hand or left-hand hinge hanging of the door 12. The upper ends of the hinge and lock frame members are then releasibly interconnected with the upper head frame member 18 through the tabs 86 and 88 as aforedescribed. The lower ends of the hinge and lock frame members are then securred to the opposite ends of the sill member 20 through screws 96 so as to form a substantially rectangular frame assembly of predetermined width and height sufficient to enable insertion of the webs 14*b*, 16*b* and flanges 14*c*, 16*c*, into the door opening in which the door and frame assembly is to be installed.

After assembling the frame members and lower sill, the resulting framework is positioned within the door opening such that the coplanar flanges 14*a*, 16*a* and 18*a* lie against the outwardly facing edges of the jambs 24*a,b* and header jamb (not shown). When properly plumbed, the flange and web portions of the respective frame members 14, 16 and 18 are secured within the door opening. For this purpose, the outer flanges 14*a*, 16*a* and 18*a* have elongated slots formed therethrough such as indicated at 106 in FIGS. 2 and 3. The slots 106 are preferably formed transversely of the respective frame member flanges and enable securing of the frame members to the underlying wooden jambs by nails or the like. With the frame members thus positioned, mounting screws, such as indicated at 108 in FIG. 3, are inserted through counter sunk openings 110 provided along the length of each of the webs 14*b* and 16*d* in the hinge and lock frame members 14 and 16, respectively, the screws 108 being of sufficient length to extend into the vertical jambs 24*a* and 24*b* and providing substantially rigid assembly of the frame within the door opening. Shims (not shown) may be inserted between webs 14*b* and 16*b* and the underlying jambs to maintain rigidity and desired spacing. With the hinge frame member 14, lock frame member 16 and head frame member 18 being thus mounted within the door opening, the door 12 may be then mounted on the frame assembly through the hinges 46, 56 and 58.

To facilitate mounting of molding or other desired trim, such as indicated at 112 in FIG. 3, about the door frame to overlie a substantial portion of the exposed flanges 14*a*, 16*a* and 18*a*, each of the flanges 14*a*, 16*a* and 18*a* is provided with an indicating "tic" or marking in the form of a T-shaped mark adjacent each of the elongated slots 106, such as indicated at 116. The indicator markings 116 are formed in predetermined relation to their corresponding slots 106 and provide reference markings for positioning the inner edge of the associated trim or molding 112 and for indicating to the installer where an opening through the underlying metallic flange exists for purposes of driving a nail through the molding into the underlying wooden jamb member or other structural member to maintain the molding in mounted relation.

A stop member 118 of wood or other suitable material, or of wood with a suitable weather strip thereon, may be mounted along each of the vertical jambs 24*a,b* and along the upper horizontal jamb (not shown) to provide a stop and suitable weather stripping for the door, as illustrated in FIGS. 3 and 5.

Thus, in accordance with the present invention, a reversible door and frame assembly is provided which enables the door to be selectively hung for either a left-hand or right-hand opening. The hinge and lock frame members may be readily reversed end for end to accommodate the selected hinge mounting of the door, it being appreciated that the striker plate 78 and cover plate 80 may require interchanging depending upon the initial assembly of the striker and cover plates within the openings 70*a,b*.

While a preferred embodiment of the present invention has been illustrated and described, it will be understood that changes and modifications may be made therein without departing from the invention in its broader aspects. Various features of the invention are defined in the following claims.

What is claimed is:

1. A reversible door and frame assembly adapted for inertion into a door opening defined by laterally spaced generally vertical jamb members or the like and a substantially horizontal header member or the like, said door and frame assembly comprising, in combination, an elongated hinge frame member having at least two hinge plates fixed thereto in symmetrical relation to the longitudinal midpoint of said hinge frame member and defining a hinge axis, an elongated lock frame member of substantially equal length to said hinge frame member, said lock frame member having a generally planar web surface in which is formed a pair of substantially rectangular openings in symmetrical relation about the longitudinal midpoint of said lock frame member, a mounting plate fixed to said lock frame member rearwardly of each of said rectangular openings, a striker plate and a cover plate adapted to be releasably and interchangeably mounted on said mounting plates within said rectangular openings so as to lie in substantially coplanar relation with the outer surface of said web surface, a head frame member having opposite ends adapted for releasable interconnection to either end of said hinge frame and lock frame members in a manner to establish substantially fixed lateral spacing between said hinge frame and lock frame members, and a door having laterally opposite longitudinal edge surfaces at least one of which defines an outwardly extending flange having a plurality of transverse recesses formed therein each of which is adapted to receive a hinge plate in mounted relation therein in a manner enabling reversal of the hinge plates for hinge cooperation with said hinge plates on said hinge frame member so as to enable hinged mounting of said door thereon, the opposite lateral edge of said door member having a latch mechanism mounted thereon spaced a predetermined distance from the midpoint of said opposite lateral edge for substantially horizontal alignment with one of said substantially rectangular openings in said lock frame member, said hinge frame member and said lock frame member having substantially identical opposite ends and being reversible end for end so as to enable reversible mounting within said door opening, said hinge plates on said door being reversible to enable reversible mounting of said door on said hinge frame member with said latch mechanism in alignment with one of said rectangular openings in said lock frame member so that interchanging the positions of said striker plate and said cover plate enable releasable locking of said door in a closed position when mounted for either right-hand or left-hand opening.

2. A door and frame assembly as defined in claim 1 wherein the opposite ends of said hinge and lock frame members have tabs formed thereon extending outwardly therefrom in normal relation thereto, and including a lower sill adapted for cooperation with the tabs on the lower ends of said hinge and lock frame members so as to maintain the lower ends of said hinge and lock frame members in fixed laterally spaced relation.

3. A door and frame assembly as defined in claim 1 wherein said hinge frame, lock frame and head frame members are of substantially C-shaped channel section and define web surfaces which establish a door receiving opening when said frame members are mounted within said door opening.

4. A door and frame assembly as defined in claim 1 wherein said hinge frame member has three hinge plates mounted thereon one of which is mounted at the longitudinal midpoint of said hinge frame member and the other two of which are mounted in symmetrical spaced relation relative to the centrally located hinge plate.

5. A door and frame assembly as defined in claim 1 wherein said lock frame member includes a lock bolt opening in its web surface at the longitudinal midpoint of said lock frame member.

6. A door and frame assembly as defined in claim 3 wherein said C-shaped channel members have flange portions thereon adapted for substantially coplanar relation when mounted within said door opening, said flange portions having elongated openings therein facilitating attachment of said frame members to said vertical jamb members and horizontal header member.

7. A reversible door and frame assembly adapted for insertion into a door opening defined by laterally spaced generally vertical jamb members or the like and a substantially horizontal header member or the like, said door and frame assembly comprising, in combination, an elongated hinge frame member having at least two hinge plates fixed thereto in symmetrical relation to the longitudinal midpoint of said hinge frame member and defining a hinge axis, an elongated lock frame member of substantially equal length to said hinge frame member, said lock frame member having a generally planar web surface in which is formed a pair of substantially rectangular openings in symmetrical relation about the longitudinal midpoint of said lock frame member, a mounting plate fixed to said lock frame member rearwardly of each of said rectangular openings, a striker plate and a cover plate adapted to be releasably and interchangeably mounted on said mounting plates within said rectangular openings so as to lie in substantially coplanar relation with the outer surface of said web surface, a head frame member having opposite ends adapted for releasable interconnection to either end of said hinge frame and lock frame members in a manner to establish substantially fixed lateral spacing between said hinge frame and lock frame members, and a door having laterally opposite longitudinal edge surfaces one of which has at least one pair of hinge plates releasably mounted thereon for hinge cooperation with said hinge plates on said hinge frame member so as to enable hinged mounting of said door thereon, the opposite lateral edge of said door member having a latch mechanism mounted thereon spaced a predetermined distance from the midpoint of said opposite lateral edge for substantially horizontal alignment with one of said substantially rectangular openings in said lock frame member, said hinge frame, lock frame and head frame members being of substantially C-shaped channel section and having flange portions adapted for substantially co-planar relation when said frame members are mounted within said door opening, said flange portions each having elongated openings therein facilitating attachment of said frame members to said vertical jamb members and horizontal header member, said flange portions of said frame members having marking indicia formed thereon adjacent each of said elongated openings to identify the locations of said openings and facilitate mounting of trim pieces in predetermined relation to said flange portions.

8. A door and frame assembly as defined in claim 4 wherein said hinge frame member defines a substantially planar web and an integral relatively broad faced flange, said flange having a plurality of openings therein adapted to receive said hinge plates therethrough so as to enable said hinge plates to be fixedly secured to the inner surface of said web.

9. A door and frame assembly as defined in claim 1 wherein the opposite ends of said hinge frame and lock frame members have means thereon adapted to enable releasible connection to a lower sill.

10. A door and frame assembly as defined in claim 1 wherein said door has a predetermined thickness and includes substantially identical laterally opposite longitudinal edges each of which is defined by a laterally outwardly extending mounting flange having smaller transverse width than the thickness of said door, one of said mounting flanges having said transverse hinge plate slots formed therein to enable reversible mounting of a hinge plate therein such that its corresponding hinge axis extends outwardly from a selected one of the side surfaces of said door.

11. A door and frame assembly as defined in claim 1 wherein said mounting plates are of substantially identical configuration and each has an opening therein adapted for alignment with an opening in a striker plate when mounted thereon.

12. A reversible door and door frame kit adapted for assembly in a manner enabling insertion into a door opening defined by laterally spaced generally vertical jamb members or the like and a substantially horizontal header member or the like, said door and door frame kit comprising:

an elongated hinge frame member having at least two hinge plates fixed thereto in symmetrical relation to the longitudinal midpoint of said hinge frame member and defining a hinge axis, an elongated lock frame member of substantially equal length to said hinge frame member, said lock frame member having a generally planar web surface in which is formed a pair of substantially rectangular openings in symmetrical relation about the longitudinal midpoint of said lock frame member, a mounting plate fixed to said lock frame member rearwardly of each of said rectangular openings, a striker plate and a cover plate adapted to be releasably and interchangeably mounted on said mounting plates within said rectangular openings so as to lie in substantially coplanar relation with the outer surface of said web surface, a head frame member having opposite ends adapted for releasable interconnection to either end of said hinge frame and lock frame members in a manner to establish substantially fixed lateral spacing between said hinge frame and lock frame members, and a door having laterally opposite longitudinal edge surfaces at least one of which defines and outwardly extending flange having a plurality of transverse recesses formed therein each of which is adapted to receive a hinge plate in mounted relation therein in a manner enabling reversal of the hinge plates for hinge cooperation with said hinge plates on said hinge frame member so as to enable hinged mounting of said door thereon, the opposite lateral edge of said door member having a latch mechanism mounted thereon spaced a predetermined distance from the midpoint of said opposite lateral edge for substantially horizontal alignment with one of said rectangular openings in said lock frame member, said hinge frame member and said lock frame member having substantially identical opposite ends and being reversible end for end so as to enable reversible mounting within said door opening, said hinge plates on said door being reversible to enable reversible mounting of said door on said hinge frame member with said latch mechanism in alignment with one of said rectangular openings in said lock frame member so that interchanging the positions of said striker plate and said cover plate enable releasable locking of said door in a closed position when mounted for either right-hand or left-hand opening.

13. A door and door frame kit as defined in claim 12 including a sill member adapted for cooperation with the lower ends of said hinge and lock frame members so as to maintain the lower ends of said hinge and lock frame members in fixed laterally spaced relation.

14. A door and door frame kit as defined in claim 12 wherein said hinge frame, lock frame and head frame members are of substantially C-shaped channel section having flange portions thereon adapted for substantially coplanar relation when mounted within said door opening, said flange portions having elongated openings therein facilitating attachment of said frame members to said vertical jamb members and horizontal header member.

15. A door and door frame kit as defined in claim 12 wherein said hinge frame member has three hinge plates mounted thereon one of which is mounted at the longitudinal midpoint of said hinge frame member and the other two of which are mounted in symmetrical spaced relation relative to the centrally located hinge plate.

16. A door and frame assembly as defined in claim 15 wherein said flange portions of said frame members have marking indicia thereon adjacent each of said elongated openings to facilitate mounting of trim pieces in predetermined relation to said flange portions.

17. A door and door frame kit as defined in claim 12 wherein the opposite ends of said hinge frame member, lock frame member and head frame member have tab means thereon adapted to enable releasible connection of the hinge and lock frame members to said head frame member.

* * * * *